US010022742B2

(12) United States Patent
Goodwin et al.

(10) Patent No.: US 10,022,742 B2
(45) Date of Patent: Jul. 17, 2018

(54) APPLICATOR WITH COLLAPSIBLE WAND

(71) Applicant: OMS Investments, Inc., Los Angeles, CA (US)

(72) Inventors: Randy M. Goodwin, Grove City, OH (US); Paul Havlovitz, Dublin, OH (US); Sean David Montag, Westerville, OH (US); Jay F. Perkins, Pickerington, OH (US)

(73) Assignee: OMS Investments, Inc., Los Angeles, CA (US)

( * ) Notice: Subject to any disclaimer, the term of this patent is extended or adjusted under 35 U.S.C. 154(b) by 0 days.

(21) Appl. No.: 15/828,079

(22) Filed: Nov. 30, 2017

(65) Prior Publication Data

US 2018/0085770 A1 Mar. 29, 2018

Related U.S. Application Data

(63) Continuation of application No. 13/038,208, filed on Mar. 1, 2011.

(51) Int. Cl.

| | |
|---|---|
| ***B05B 15/652*** | (2018.01) |
| ***B05B 15/06*** | (2006.01) |
| ***B05B 9/08*** | (2006.01) |
| *B05B 9/04* | (2006.01) |

(52) U.S. Cl.

CPC ..... *B05B 15/652* (2018.02); *B05B 9/0861* (2013.01); *B05B 15/066* (2013.01); *B05B 9/0426* (2013.01)

(58) Field of Classification Search

CPC .... B05B 9/03; B05B 9/01; B05B 1/00; B05B 15/066; B05B 9/0861; B05B 9/0426; B05B 15/652

USPC ..... 239/332; 222/333, 383.3, 527, 530, 533, 222/538, 381, 380, 372

See application file for complete search history.

(56) References Cited

U.S. PATENT DOCUMENTS

| | | | |
|---|---|---|---|
| 241,307 | A | 5/1881 | Corwin |
| 260,829 | A | 7/1882 | Bradley |
| 337,268 | A | 3/1886 | Keedy |
| 557,987 | A | 4/1896 | Frank |
| 813,254 | A | 2/1906 | Sweeney |
| 1,264,503 | A | 4/1918 | Griffin |
| 1,456,408 | A | 5/1923 | Scherer |
| 1,521,831 | A | 1/1925 | Olvawitsz |
| 1,544,503 | A | 6/1925 | Wayne |

(Continued)

FOREIGN PATENT DOCUMENTS

| | | | |
|---|---|---|---|
| EP | 591601 | A1 | 4/1994 |
| EP | 677401 | A2 | 10/1995 |

(Continued)

OTHER PUBLICATIONS

Air Wick Odor Stop Product Promotion retrieved from the Internet at www.winwithairwick.co.nz/airwick_entry_form.pdf, 2006.

(Continued)

*Primary Examiner* — Chee-Chong Lee
(74) *Attorney, Agent, or Firm* — Ulmer & Berne LLP

(57) ABSTRACT

An applicator comprises a housing having a liquid input, a pump, a motor, and a power source; a trigger for providing selective control over the pump; a wand hingedly connected to the housing; and a nozzle coupled to the wand for discharging liquid from the applicator. The nozzle and the liquid input are in fluid communication via the pump and various conduits of the applicator.

51 Claims, 10 Drawing Sheets

(56) References Cited

U.S. PATENT DOCUMENTS 1,595,231 A 8/1926 Dryer
1,631,951 A 6/1927 McAnsh
1,912,759 A 6/1933 Clark
1,982,094 A 11/1934 Gessler
2,006,437 A 7/1935 Burgess et al.
2,050,522 A 8/1936 Evans et al.
2,135,665 A 11/1938 Hoban
2,246,211 A 6/1941 Kilich
2,248,701 A 7/1941 Fowler
2,293,390 A 8/1942 Hengesbach
2,348,205 A 5/1944 Chater
2,388,445 A 11/1945 Stewart
2,416,719 A 3/1947 Stockdale
2,460,545 A 2/1949 Spreng
2,485,723 A 10/1949 Fitzgerald
2,536,361 A 1/1951 Flanders
2,580,629 A 1/1952 Wenzel
2,599,678 A 6/1952 Walker
2,603,388 A 7/1952 Bryant
2,647,798 A 8/1953 Ballard
2,673,664 A 3/1954 Boysen
2,711,928 A 6/1955 Randa
2,754,152 A 7/1956 Gilmour
2,760,820 A 8/1956 Cirese
2,788,244 A 4/1957 Gilmour
2,788,245 A 4/1957 Gilmour
2,951,645 A 9/1960 Price et al.
2,961,335 A 11/1960 Shepard
2,981,284 A 4/1961 Putnam
2,991,939 A 7/1961 Packard
3,088,679 A 5/1963 Ford
3,104,823 A 9/1963 Hayes
3,123,253 A 3/1964 Lambton
3,140,018 A 7/1964 Miller
D200,960 S 4/1965 Beinert
3,181,797 A 5/1965 Hayes
3,185,358 A 5/1965 Marler
3,207,443 A 9/1965 Gilmour
3,233,783 A 2/1966 Thornton
3,253,788 A 5/1966 McHugh et al.
3,254,844 A 6/1966 Blasnik et al.
3,255,924 A 6/1966 Modderno
3,319,893 A 5/1967 Rodgers
3,323,685 A 6/1967 Schultz
3,372,846 A 3/1968 Berkus
3,381,899 A 5/1968 Forsman
3,401,840 A 9/1968 McConnell et al.
3,443,726 A 5/1969 Muller et al.
3,445,067 A 5/1969 Sheldall
3,447,753 A 6/1969 Proctor et al.
3,467,314 A 9/1969 Grubb
3,499,606 A 3/1970 Smith
3,632,046 A 1/1972 Hengensbach
3,655,099 A 4/1972 Hazard
3,764,074 A 10/1973 James
3,770,205 A 11/1973 Proctor et al.
3,800,786 A 4/1974 Kovach
3,833,177 A 9/1974 Pasley et al.
D234,952 S 4/1975 Rouquie
D235,063 S 5/1975 Gunzel, Jr. et al.
3,940,069 A 2/1976 Gunzel, Jr. et al.
3,964,689 A 6/1976 Horvath
3,993,245 A 11/1976 Smith
4,027,822 A 6/1977 Usher
4,058,259 A 11/1977 Schantz
D251,793 S 5/1979 DeGelder
4,153,184 A 5/1979 Parish et al.
4,250,911 A 2/1981 Kratz
4,291,814 A 9/1981 Conn
4,349,157 A 9/1982 Beiswenger et al.
4,382,552 A 5/1983 Lubsen et al.
4,396,356 A 8/1983 Thompson
4,418,869 A 12/1983 Healy
4,442,977 A 4/1984 Beiswenger et al.
4,491,254 A 1/1985 Viets et al.
4,527,740 A 7/1985 Gunzel, Jr. et al.
D281,899 S 12/1985 Gunzel, Jr. et al.
D281,900 S 12/1985 Gunzel, Jr. et al.
4,618,099 A 10/1986 Nagao et al.
4,624,413 A 11/1986 Corsette
4,651,930 A 3/1987 Magaha, Jr.
4,664,301 A 5/1987 Hoyt
4,706,888 A 11/1987 Dobbs
4,785,850 A 11/1988 Sanchez
D298,848 S 12/1988 Chow et al.
4,811,870 A 3/1989 Bianco
4,826,085 A 5/1989 Chow et al.
4,878,619 A 11/1989 Norman
4,890,340 A 1/1990 Lovitt
4,890,792 A 1/1990 Martin et al.
4,901,923 A 2/1990 McRoskey et al.
4,901,976 A 2/1990 Smith
4,925,105 A 5/1990 Lin
4,982,896 A 1/1991 Crow
D322,838 S 12/1991 Hagedorn
5,069,389 A 12/1991 Bitsakos
5,097,540 A 3/1992 Lovitt
5,110,231 A 5/1992 Monteith et al.
5,143,294 A 9/1992 Lintvedt
5,203,468 A 4/1993 Hsu
5,205,424 A 4/1993 Gaspar
5,213,264 A 5/1993 Styne
5,213,265 A 5/1993 Englhard et al.
5,263,646 A 11/1993 McCauley et al.
5,277,343 A 1/1994 Parsonage
5,279,461 A 1/1994 Darroch
5,332,158 A 7/1994 Styne et al.
5,335,858 A 8/1994 Dunning et al.
5,346,081 A 9/1994 Lin
5,356,076 A 10/1994 Bishop
5,375,769 A 12/1994 Schultz
5,388,712 A 2/1995 Brody
5,413,280 A 5/1995 Taylor
5,469,993 A 11/1995 Hauf et al.
5,484,106 A 1/1996 Gilmond
5,499,766 A 3/1996 Foster et al.
5,522,547 A 6/1996 Dobbs et al.
5,526,985 A 6/1996 Martin
5,590,837 A 1/1997 Grogan
5,593,094 A 1/1997 Barriac et al.
5,628,461 A 5/1997 Foster et al.
5,641,125 A 6/1997 Martin et al.
5,673,824 A 10/1997 Evans
5,678,768 A 10/1997 Gager et al.
5,685,487 A 11/1997 Ellis
5,711,251 A 1/1998 Green et al.
5,727,736 A 3/1998 Tryon
5,738,282 A 4/1998 Grogan
5,755,384 A 5/1998 Foster et al.
5,864,895 A 2/1999 Ota et al.
5,868,321 A 2/1999 Haruch
5,878,959 A 3/1999 Smolen, Jr. et al.
5,881,955 A 3/1999 Styne
5,890,628 A 4/1999 Simpson et al.
5,918,621 A 7/1999 Gilmore
5,954,272 A 9/1999 Liao
5,964,415 A 10/1999 Hadar
5,975,164 A 11/1999 Whaley et al.
5,996,858 A 12/1999 Tapp et al.
6,126,090 A 10/2000 Wadsworth et al.
6,131,774 A 10/2000 Thomas et al.
6,170,706 B1 1/2001 Havlovitz
6,186,366 B1 2/2001 Good et al.
6,213,410 B1 4/2001 Spitznagel
6,223,999 B1 5/2001 Lemelshtrich et al.
6,279,773 B1 8/2001 Kiyota
D447,791 S 9/2001 Robidoux
D448,450 S 9/2001 Lawson et al.
6,293,294 B1 9/2001 Loeb et al.
6,390,335 B1 5/2002 Lawson et al.
D459,438 S 6/2002 Knowles
6,402,053 B1 6/2002 Chih
6,415,956 B1 7/2002 Havlovitz
6,419,166 B1 7/2002 Brzezinski et al.

(56) References Cited

U.S. PATENT DOCUMENTS

| | | | |
|---|---|---|---|
| 6,422,485 | B1 | 7/2002 | Hsu |
| 6,453,953 | B1 | 9/2002 | Adriansens et al. |
| 6,511,001 | B1 | 1/2003 | Huang |
| 6,536,684 | B1 | 3/2003 | Wei |
| 6,546,949 | B1 | 4/2003 | Gilmore |
| D476,558 | S | 7/2003 | Cho et al. |
| 6,595,437 | B1 | 7/2003 | Lawson et al. |
| 6,604,546 | B1 | 8/2003 | Gilmore |
| 6,609,733 | B2 | 8/2003 | Gilmore |
| 6,612,506 | B1 | 9/2003 | Huang |
| 6,712,292 | B1 | 3/2004 | Gosis et al. |
| 6,715,698 | B2 | 4/2004 | Foster et al. |
| 6,726,123 | B2 | 4/2004 | Wang |
| D489,970 | S | 5/2004 | Nelson et al. |
| 6,761,324 | B2 | 7/2004 | Chang |
| 6,851,632 | B2 | 2/2005 | Ferrazza et al. |
| 6,896,203 | B1 | 5/2005 | Restive |
| D507,493 | S | 7/2005 | Nelson et al. |
| 6,976,640 | B2 | 12/2005 | Chen |
| 6,976,644 | B2 | 12/2005 | Troudt |
| 6,978,946 | B2 | 12/2005 | Sweeton |
| 6,988,675 | B2 | 1/2006 | Hubmann et al. |
| 7,017,833 | B2 | 3/2006 | Foster |
| 7,021,571 | B1 | 4/2006 | Lawson et al. |
| D524,906 | S | 7/2006 | Birrenkott et al. |
| 7,083,125 | B2 | 8/2006 | Westphal et al. |
| 7,086,610 | B2 | 8/2006 | Hubmann et al. |
| D529,575 | S | 10/2006 | Birrenkott et al. |
| 7,156,324 | B2 | 1/2007 | Birrenkott et al. |
| 7,168,629 | B2 | 1/2007 | Timmes et al. |
| D537,359 | S | 2/2007 | Butler et al. |
| 7,182,280 | B2 | 2/2007 | Ye et al. |
| D539,142 | S | 3/2007 | Butler et al. |
| D559,682 | S | 1/2008 | Meeker et al. |
| D561,301 | S | 2/2008 | Troyer |
| 7,337,989 | B1 | 3/2008 | Penner et al. |
| D569,478 | S | 5/2008 | Cichy et al. |
| D582,272 | S | 12/2008 | Cichy |
| D619,215 | S | 7/2010 | Havlovitz et al. |
| 7,837,132 | B2 | 11/2010 | Mazooji et al. |
| 8,003,121 | B1 | 8/2011 | Dingeldein et al. |
| D670,982 | S | 11/2012 | Goodwin et al. |
| D736,577 | S | 8/2015 | Goodwin et al. |
| D779,898 | S | 2/2017 | Goodwin et al. |
| D797,529 | S | 9/2017 | Goodwin et al. |
| 2004/0007633 | A1 | 1/2004 | Simmons |
| 2004/0050959 | A1 | 3/2004 | Mazooji et al. |
| 2004/0222246 | A1 | 11/2004 | Bates et al. |
| 2005/0145270 | A1 | 7/2005 | Ray |
| 2005/0173452 | A1 | 8/2005 | Brown et al. |
| 2006/0013709 | A1 | 1/2006 | Hudson et al. |
| 2006/0255183 | A1 | 11/2006 | Burdsall et al. |
| 2007/0125878 | A1 | 6/2007 | Hahn et al. |
| 2007/0170285 | A1 | 7/2007 | Schouten |
| 2007/0228187 | A1 | 10/2007 | Nelson et al. |
| 2008/0011882 | A1 | 1/2008 | Foster et al. |
| 2008/0061167 | A1 | 3/2008 | Gansebom |
| 2010/0044454 | A1 | 2/2010 | Karazniewicz |
| 2010/0163646 | A1 | 7/2010 | Havlovitz et al. |
| 2010/0170964 | A1 | 7/2010 | Fedorov |
| 2012/0223160 | A1 | 9/2012 | Goodwin et al. |
| 2013/0068857 | A1 | 3/2013 | Hite |

FOREIGN PATENT DOCUMENTS

| | | | |
|---|---|---|---|
| EP | 798158 | A2 | 10/1997 |
| EP | 1022060 | A2 | 7/2000 |
| FR | 2708569 | A1 | 2/1995 |
| GB | 1329788 | A | 9/1973 |
| GB | 1386186 | A | 3/1975 |
| GB | 2018626 | A | 10/1979 |
| GB | 2286109 | A | 8/1995 |
| WO | 0209783 | A1 | 2/2002 |
| WO | 2012118949 | A2 | 9/2012 |

OTHER PUBLICATIONS

International Search Report for International Patent Application No. PCT/US2006/026119, dated Jan. 5, 2007.

International Search Report for International Patent Application No. PCT/US2009/069396, dated Mar. 1, 2010.

Extended European Search Report for European Application No. 06774502.6, dated Jul. 23, 2009.

International Search Report and Written Opinion for International Patent Application No. PCT/US2012/027242, dated Jun. 6, 2012.

Extended Search Report for European Application No. 12752589.7, dated Oct. 14, 2014.

Search Report for Chinese Application No. 201280021146.3, dated Jul. 3, 2015.

Supplementary Search Report for Chinese Application No. 201280021146.3, dated Jul. 13, 2016.

APPLICATOR WITH COLLAPSIBLE WAND

CROSS-REFERENCE TO RELATED APPLICATION

The present application is a continuation of U.S. application Ser. No. 13/038,208, entitled "APPLICATOR WITH COLLAPSIBLE WAND", filed Mar. 1, 2011, the disclosure of which is hereby incorporated by reference in its entirety.

BACKGROUND

1. Field of the Art

The present invention relates to an applicator, and more particularly to an applicator with a collapsible wand and a rotatable nozzle for dispensing ready-to-use liquid products, such as fertilizer or pesticide (e.g., herbicides, fungicides, and insecticides) compositions

2. Description of Related Art

There are many known applicators for dispensing chemicals or other products to maintain lawns, gardens, yards, trees, shrubs, or plants. Most applicators are used with ready-to-use ("RTU") liquids, such as fertilizers, herbicides, insecticides, and fungicides, which can be dispensed directly from the applicator. Indeed, many handheld spray devices for spraying RTU liquid currently exist. The most common spray devices have an integrated, all-in-one design where a bottle is integrally formed with or removably connected to an applicator. Such all-in-one spray devices, however, have limited functionality and usefulness. For example, the weight of the RTU liquid in the bottle can be tiring to a user when holding typical handheld spray devices.

Many conventional applicators are manually actuated or "pump-type" sprayers that rely upon the user to squeeze an actuation trigger to discharge the liquid from the sprayer. These types of sprayers often possess several drawbacks. For example, such "pump-type" sprayers require the manually actuated trigger and the nozzle to be in close proximity to one another to achieve satisfactory spray pressures and fluid velocities. This configuration reduces design flexibility and inhibits the ability to provide applicators having a nozzle located at an extended distance from the actuation trigger. Furthermore, most manually actuated sprayers do not allow the nozzle, and, in particular, the spray angle of the nozzle, to be adjusted dynamically in relation to the actuator. Instead, conventional manually actuated sprayers have a fixed nozzle at a fixed location relative to the actuator. Additionally, manually actuated sprayers tend to result in operator fatigue because such sprayers require continuous actuation of a pumping mechanism.

Other conventional applicators for dispensing RTU liquids incorporate an automatic pump, typically powered by battery. These applicators have many of the same drawbacks of the manually actuated sprayers described above. For instance, many batter powered applicators have a RTU liquid reservoir that is integrated with the applicator. Again, this requires a user to lift and carry the weight of the RTU liquid while using the applicator.

In other instances, conventional applicators may comprises a short nozzle that is proximate to where a user grips the sprayer. This configuration results in an increased risk of contact with chemical product in the event of leakage from the nozzle. Further, this configuration results in compromised aiming and spray targeting when the user operates the device.

Other battery powered applicators may be separate from a reservoir, but these applicators also have disadvantages. For example, U.S. Published Patent Application No. 2006/0013709 by Hudson et al. ("Hudson") describes a battery-powered spray wand having a reservoir remote from the applicator. The Hudson applicator is configured such that the housing is divided into two portions. Generally, a lower housing contains a power supply, while an upper housing contains a nozzle, motor, transmission and a pump portion. The upper housing pivots relative to the lower portion, such that a user may modify the spray angle of the nozzle by pivoting the entire top portion of the housing. The Hudson applicator has several specific disadvantages. First, the nozzle is coupled directly to the upper housing. Because the upper housing is only pivotable relative to the lower housing, the movement of the nozzle is limited to the range of pivot of the upper housing. In this configuration of the Hudson applicator, the nozzle, therefore, is only pivotable to approximately 90 degrees. The Hudson applicator is unable to provide further movement. Moreover, Hudson's pivoting housing configuration is difficult to produce and expensive to manufacture. Further, the Hudson applicator is configured such that the power source is housed in a separate housing from the pump, motor, and transmission. This configuration creates potential reliability issues, as the liquid that is sprayed may leak into either the upper or lower housing, thereby interfering with the electrical circuitry within the applicator.

Notwithstanding the number of applicators that currently exist, most fail to provide for a reliable, user-friendly device that is cost-effective to manufacture and ship, easy to use and safe for a user to operate. The present invention, as demonstrated by the several exemplary embodiments described herein, provides an applicator with a collapsible arm with beneficial features that achieve improved functionality over conventional applicators. The applicator of the present invention offers numerous advantages, including: (1) a single housing incorporating a power source, motor, transmission, and pump, (2) a nozzle that is movable independent of and relative to the housing, and (3) a collapsible arm for connecting in fluid communication the nozzle to the housing.

The description herein of certain advantages and disadvantages of known methods and devices is not intended to limit the scope of the present invention. Indeed, the exemplary embodiments may include some or all of the features described above without suffering from the same disadvantages.

SUMMARY

In accordance with one embodiment, an applicator is provided comprising a housing having a liquid input, a pump, a motor, and a power source; a trigger for providing selective control over the pump; a wand hingedly connected to the housing; and a nozzle coupled to the wand for discharging liquid from the applicator. The nozzle and the liquid input are in fluid communication via the pump and various conduits of the applicator.

BRIEF DESCRIPTION OF THE DRAWINGS

Purposes and advantages of the exemplary embodiments will be apparent to those of ordinary skill in the art from the following detailed description together with the appended drawings, in which like reference numerals are used to indicate like elements.

Figure 1A:
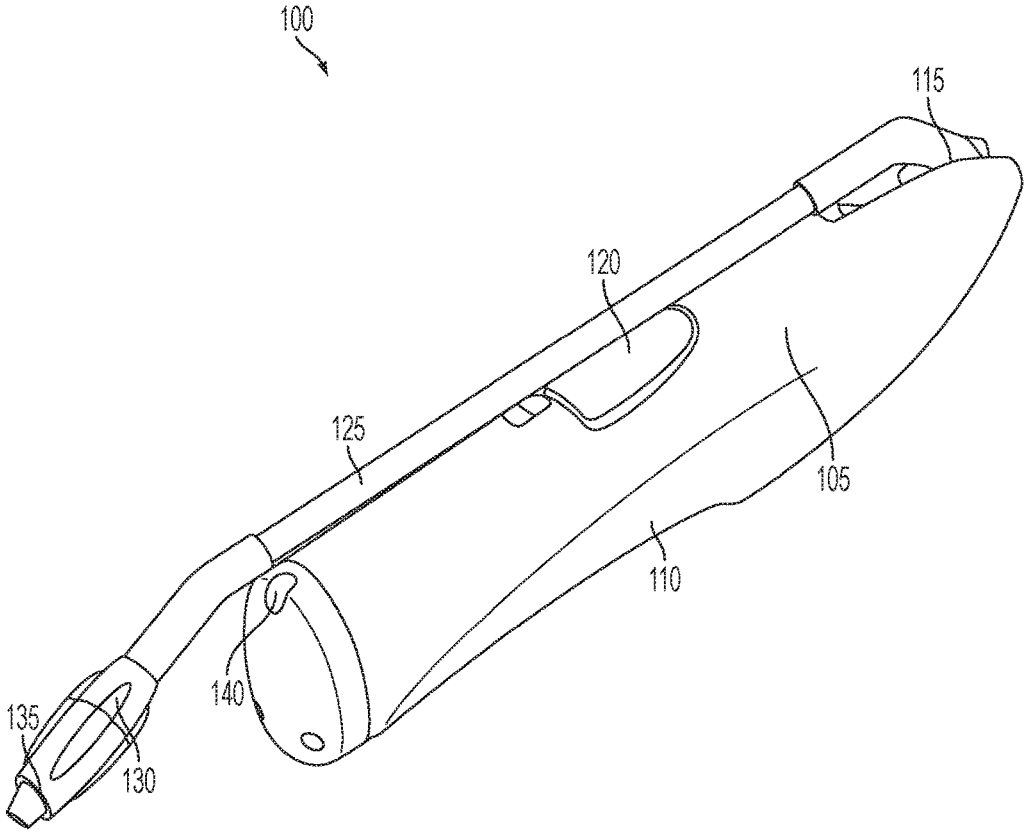
FIG. 1*a* depicts a perspective view of an applicator in accordance with an exemplary embodiment.

These and other exemplary embodiments and advantages will become apparent from the following detailed description, taken in conjunction with the accompanying drawings, illustrating by way of example the principles of the various exemplary embodiments.

DETAILED DESCRIPTION

The following description is intended to convey a thorough understanding of the embodiments by providing a number of specific embodiments and details involving an applicator with a collapsible wand. It is understood, however, that the invention is not limited to these specific embodiments and details, which are exemplary only. It is further understood that one possessing ordinary skill in the art, in light of known devices, systems and methods, would appreciate the use of the invention for its intended purposes and benefits in any number of alternative embodiments as required on specific design or other need.

Terminology used for describing particular embodiments is not intended to limit the scope of an exemplary embodiment. As used throughout this disclosure, the singular forms "a," "an," and "the" include the plural, unless the context clearly dictates otherwise. Thus, for example, a reference to a "conduit" includes a plurality of conduits, or other equivalents or variations know to those skilled in the art. Furthermore, if in describing some embodiments or features permissive language (e.g., "may") is used, that does not suggest that embodiments or features described using other language (e.g., "is," "are") are required. Unless defined otherwise, all terms have the same commonly understood meaning that one of ordinary skill in the art to which this invention belongs would expect them to have.

The accompanying figures and following description depict and describe exemplary embodiments of an applicator for discharging liquid. As used throughout this description, the terms "applicator," "sprayer" or other like terms are meant to encompass a structure adapted to discharge, dispense, project, spray, etc., liquid. In exemplary embodiments, the liquid to be discharged may be a fertilizer, a pesticide (e.g., herbicide, insecticide, fungicide, etc.), or combinations thereof. It should be appreciated, however, that the exemplary embodiments of the applicator described throughout are not limited to any specific embodiment or detail that is disclosed. Moreover, one of ordinary skill in the art will appreciate the use of the exemplary embodiments for their intended purposes and benefits in a number of alternative embodiments as required by specific design or other needs.

With regard to the exemplary embodiments of the applicator described herein, any part that fastens, mounts, attaches, or connects any component to form the sprayer shall not be limited to any particular type and is instead intended to encompass all known and conventional fasteners like screws, nut and bolt connectors, threaded connectors, snap rings, detent arrangements, clamps, rivets, toggles, etc. Fastening may also be accomplished by other known fitments like leak-tight seals or sealing devices. Components may also be connected by adhesives, glues, welding, ultrasonic welding, and friction fitting or deformation. Of course, combinations of these fitment systems might be used.

Unless otherwise specifically disclosed, materials for making components of the present invention may be selected from appropriate materials, such as metal, metal alloys, natural or manmade fibers, composites, vinyl, plastics, silicone, rubber, and so on. Any and all appropriate manufacturing or production methods, such as casting, pressing, extruding, molding, or machining may be used to construct the exemplary embodiments or their components.

Lastly, when describing exemplary embodiments of the sprayer, any reference to front and back or rear, top and bottom, right and left, upper and lower, etc., is intended for the convenience of describing such embodiments only. Such references do not limit the exemplary embodiments or its components to any specific positional or spacial orientation.

Exemplary embodiments of the sprayer will now be described more fully with reference to the accompanying drawings, in which some, but not all, embodiments are illustrated.

With reference to FIGS. 1*a*-4*b*, exemplary embodiments of an applicator in accordance with the present invention are shown. Each of the exemplary embodiments generally includes a housing having a liquid input, a pump in fluid connection with the liquid input, an electric motor for driving the pump, and a power source for providing power to the electric motor; a trigger in electronic communication with the power source and the electric motor, wherein the trigger provides selective control over the pump; a wand hingedly connected to the housing, wherein the wand is rotatable relative to the housing; a wand conduit in fluid communication with the liquid input and the pump; and a nozzle coupled to the wand for discharging liquid from the applicator, wherein the nozzle is in fluid communication with the wand conduit, the pump, and the liquid input. Other embodiments, however, may include a rotating nozzle, which may be further described herein, for providing a variety of spray patterns. Another embodiment may include any suitable trigger mechanism for actuating a standard pumping mechanism housed inside of the applicator. Each of these parts generally referred to here will be described in more detail below.

FIG. 1*a* illustrates an exemplary embodiment of an applicator 100. It should be appreciated that all of the figures herein illustrate a simplified view of an exemplary applicator 100, and its components, and that applicator 100 may include additional elements that are not depicted. The applicator 100 may generally have a housing 105 with a grip portion 110 and a trigger 120. The applicator 100 may also have a wand hinge 115, a wand 125 and a nozzle 130. Generally, the applicator 100 may be configured such that a user may grip the grip portion 110 of housing 105 while actuating the trigger 120. The wand 125 may be coupled to the housing 105 via wand hinge 115, so that the wand 125 and nozzle 130 may be rotatable relative to the housing 105, the grip portion 110, and the trigger 120.

The grip portion 110 of housing 105 may be ergonomically shaped to allow a user to comfortably grasp the applicator 100. In an exemplary embodiment, the grip portion 110 may include one or more ergonomic gripping pads or grooves (not shown). The gripping pads or grooves (not shown) may be shaped to accommodate the natural orientation of a user's grip. In one embodiment, the gripping pads or grooves (not shown) may extend along the entire grip area 110 in a substantially elongated shape. The gripping pads or grooves (not shown) may have a varied length and width and may also be changed to conform to the various designs of housing 105 and grip portion 110.

Figure 2A:
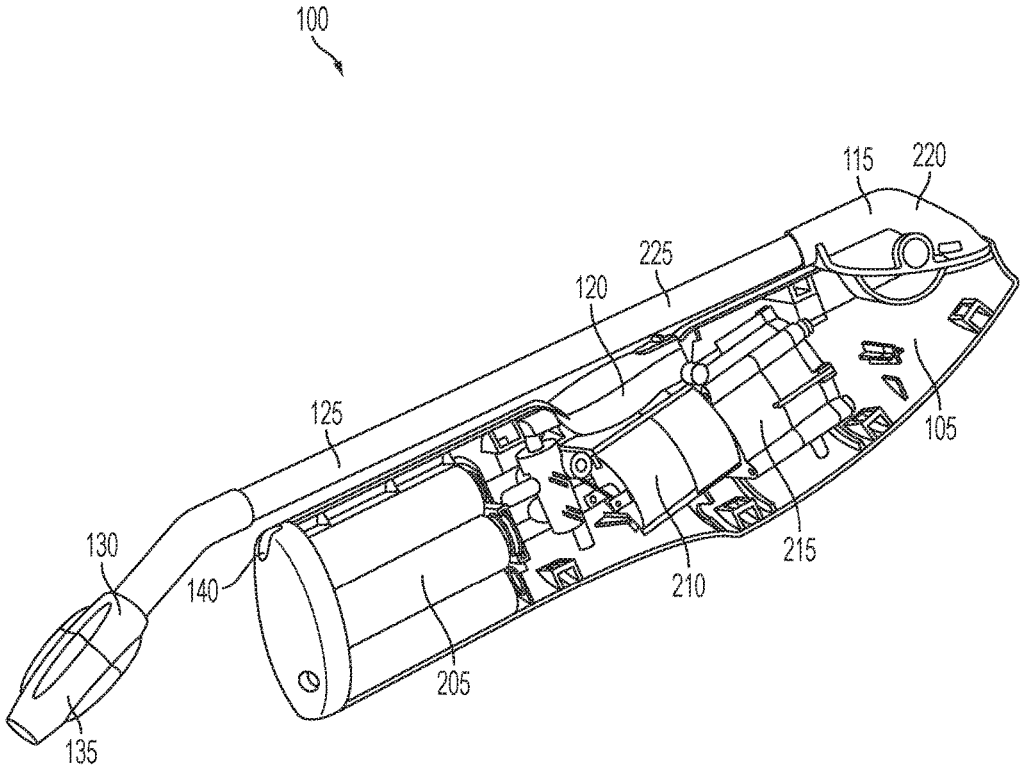
FIG. 2*a* depicts a cross-sectional view of an applicator.
Figure 2B:
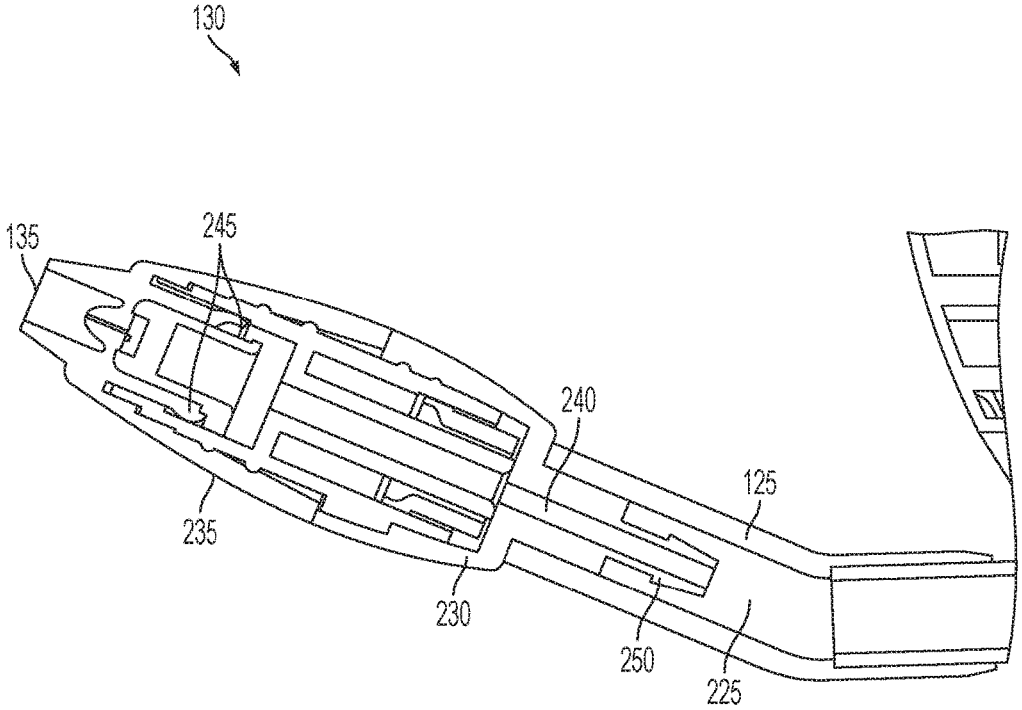
FIG. 2*b* depicts a cross-sectional view of an applicator nozzle.
Figure 2C:
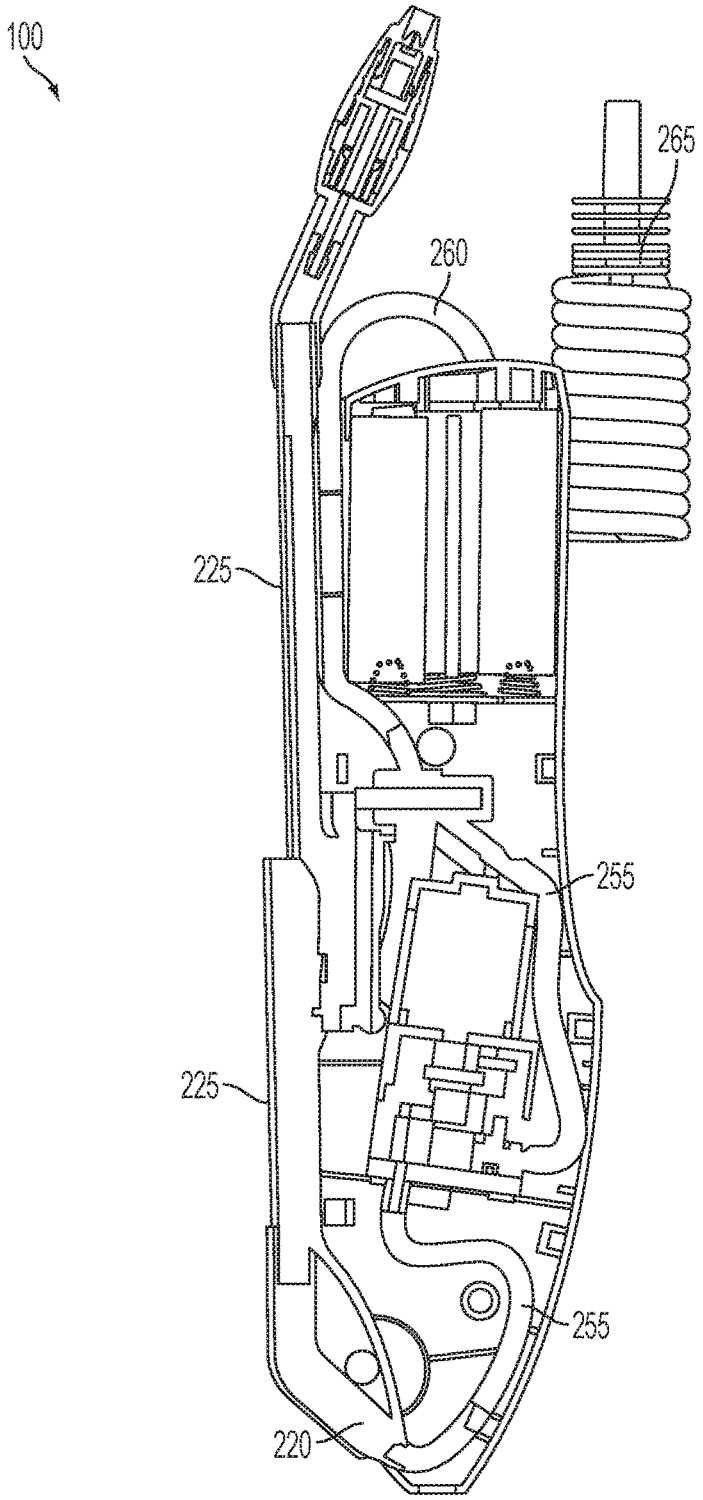
FIG. 2*c* depicts a cross-sectional view of an applicator having multiple conduits.

Moreover, the housing 105 may also include a liquid input 140 for coupling with a liquid conduit, such as liquid conduit 260 depicted with reference to FIG. 2*c*. Liquid may enter the applicator 100 via liquid input 140, where it may pass through the various conduits, chambers, valves, and pumps of the applicator 100 before being discharged via the liquid outlet 135 of nozzle 130. The nozzle 130 and liquid outlet 135 may be configured to discharge liquid in any number of ways according to any number of patterns. For example, the nozzle 130 may spray liquid in a fan, jet, or shower pattern. In an exemplary embodiment, the nozzle 130 may be adjustable to permit a user to change the liquid spray patterns by twisting or rotating the nozzle 130. In other exemplary embodiments, the nozzle 130 may regulate the spray flow, droplet size, and spray pattern of liquid as it is discharged from the applicator 100. The nozzle 130 may also be adapted to discharge liquid in any number of spray patterns, including stream jet pattern and full-cone pattern, depending upon user preference. It should be appreciated that nozzle 130 may be configured in any number of ways to support any number of applications.

Liquid input 140 may be located anywhere within the housing 105 and may be configured to couple with a liquid conduit in any number of ways. For example, liquid input 140 permanently house a liquid conduit. In another exemplary embodiment, the liquid input 140 may be threaded so that a threaded liquid conduit may be removably attached to the liquid input 140. Liquid input 140 may be removably connected to a conduit in any appropriate matter, like through threaded connectors, snap rings, detent arrangements, etc. It should be appreciated that liquid input 140 may be configured in any number of ways to provide fluid communication between applicator 100 and a liquid container, such as liquid container 400, described below with reference to FIG. 4.

Trigger 120 may be located on the housing 105. The trigger 120 may provide a user with control over the discharge of liquid from nozzle 130. The location of the trigger 120 and the grip portion 110 may be configured to permit a user to grip the grip portion 110 and activate the trigger 120 with one hand. In other exemplary embodiments, the trigger 120 may be ergonomically shaped or may include gripping pads or grooves to allow a user to easily and comfortably actuate the trigger 120 when desired. When actuated, the trigger 120 may be configured to control the operation of various internal components of the applicator 100 in order to affect the discharge of liquid from the nozzle 130. Exemplary configurations for such internal components are described below with regard to FIGS. 2*a* and 2*c*.

The wand hinge 115 may connect the wand 125 to the housing 105. FIG. 1*a* depicts an embodiment in which the wand 125 is folded to be proximate to and parallel with the housing 105. In other embodiments, the wand 125 may be folded to be at any angle relative the housing 105. The configuration depicted in FIG. 1*a* may be desirable for a user that wishes to conserve space when storing the applicator 100. Such a configuration may also provide benefits to a manufacturer, distributor or retailer, as the compact configuration minimizes space occupied by the applicator 100 during packaging, shipping, and on-shelf display. The wand hinge 115 may be rotatable so that the wand 125 may extend away from the housing 105, depending upon a user's desired operating position.

It should be understood that embodiments describing a "wand hinge" are exemplary only, and that in other exemplary embodiments the wand 125 may be hingedly connected to the housing 105. In other exemplary embodiments, the wand 125 may have hinge members (not shown) integrally molded onto it in order to facilitate motion relative to the housing 105. In another exemplary embodiment, the housing 105 may have hinge member (not shown) integrally molded onto it in order to facilitate motion relative to the wand 125. Those with skill in the art will understand that there are many other ways to configure the wand 125 and the housing 105 in order to facilitate the above-described motion of the wand 125 relative to the housing 105.

Figure 1B:
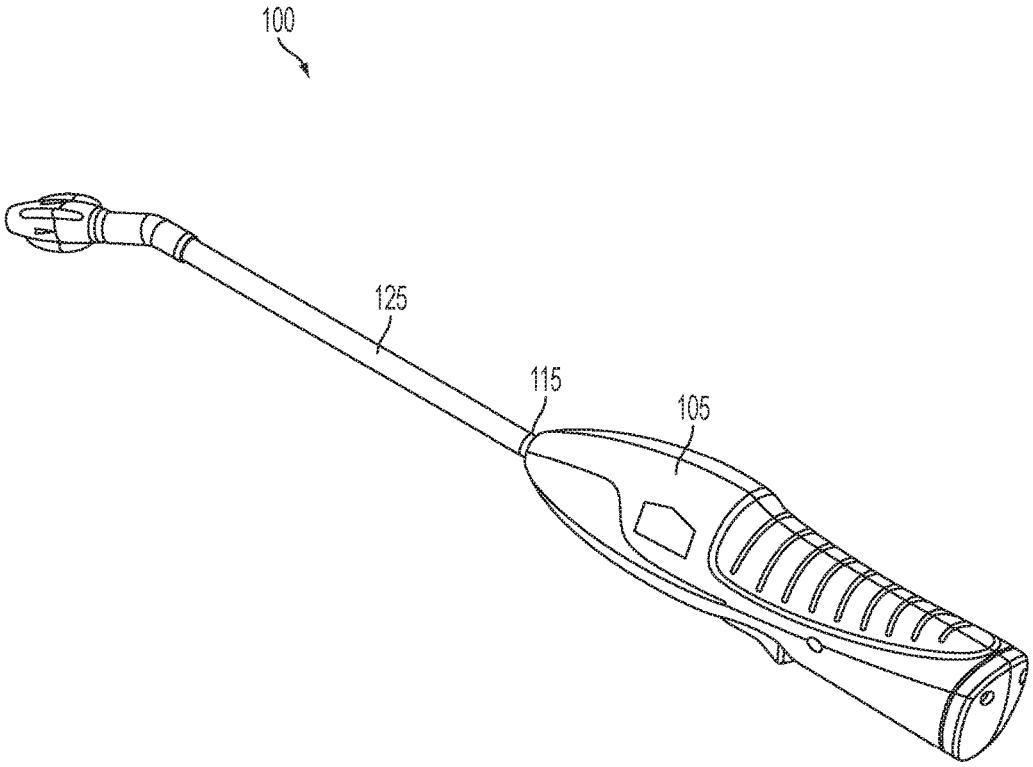
FIG. 1*b* depicts a perspective view of an applicator with an extended wand in accordance with an exemplary embodiment.

FIG. 1*b* depicts an exemplary embodiment of an applicator 100 with an extended wand 125. In this exemplary embodiment, the wand hinge 115 has rotated 180 degrees relative to the housing 105, such that the wand 125 is fully extended. In this exemplary embodiment, the extended wand 125 provides a user with increased range when using the applicator 100 to spray a liquid product, for example, a RTU liquid.

Figure 1C:
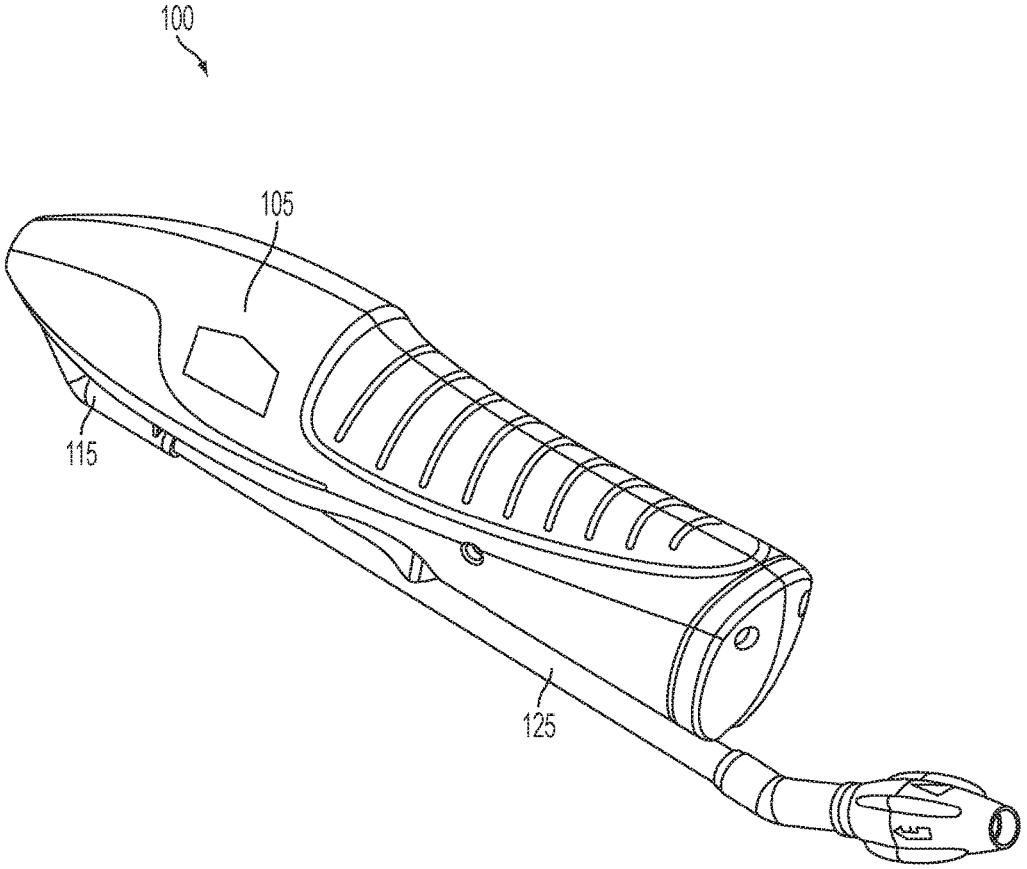
FIG. 1*c* depicts a perspective view of an applicator having a collapsed wand in accordance with an exemplary embodiment.

FIG. 1*c* depicts an exemplary embodiment of an applicator 100 with a collapsed wand 125. In this exemplary embodiment, the wand hinge 115 has rotated so that the wand 125 has collapsed to be proximate to and parallel with the housing 105. In this exemplary embodiment, as discussed above with regard to the exemplary embodiment of FIG. 1*a*, the collapsed wand 125 provides a compact configuration to enable more efficient shipping and storage of the applicator 100. Of course, it should be appreciated that FIGS. 1*b* and 1*c* depict only two of any number of applicator configurations. The wand hinge 115 may be configured to provide any degree of rotation between the wand 125 and the housing 105.

FIGS. 2*a* and 2*c* illustrate cross sectional views of applicator 100. Generally, the housing 105 may have any number of internal components, including, but not limited to, power source 205, motor 210, pump 215, and housing conduit 255. Applicator 100 may also have a wand 125 having a wand conduit 225. Housing conduit 255 and wand conduit 225 may be fluidly connected via hinge conduit 220, which may be housed within wand hinge 115. In an exemplary embodiment, housing conduit 255, wand conduit 225, and hinge conduit 220 may be configured to form one, continuous conduit to provide fluid connection from liquid input 140 to nozzle 130. In another exemplary embodiment, housing conduit 255, wand conduit 225 and hinge conduit 220 may be separate conduits that are fluidly connected. In one exemplary embodiment, the housing conduit 255, the wand conduit 225, and the hinge conduit 220 may be flexible tubes.

Housing conduit 255 may be configured to provide fluid communication between liquid input 140 and pump 215. Housing conduit 255 may also provide a fluid connection between pump 215 and the remaining conduits of applicator 100. Housing conduit 255 and pump 215 may be configured in any number of ways so that pump 215 may operate to pump liquid from liquid input 140, through the various conduits of applicator 100, to the nozzle 130, where the liquid may be discharged from the applicator 100 via the liquid outlet 135. Those with skill in the art will understand that any number of standard pumping mechanisms may be employed to circulate the flow of liquid through the various conduits of applicator 100. Suitable pumps include centrifugal, vane, lobe, diaphragm, positive displacement, or rotary gear pumps. While there are many different types of pumps for pumping fluid from the liquid input 140, a rotary gear pump may be effective due to its stable, non-pulsing motion, which ensures static flow during operation. The pump 215 may comprise either external gear pumps or internal gear pumps. As is commonly understood in the art, the pump 215 may use the meshing of gears to pump liquid, by displacement, from a liquid source connected to the liquid input 140. In an exemplary embodiment, the liquid source may be container 400, as described below with regard to FIG. 4*a*. It should be understood, as previously mentioned, that the applicator 100 is not limited to any particular type of pump mechanism.

As depicted in FIG. 2*a*, the applicator 100 may have a pump 215, which may be electronically coupled and driven by a motor 210. The motor 210, in turn, may be powered by power source 205. The power source 205 may be a rechargeable battery, one-time disposable battery (or batteries), or battery pack. In an exemplary embodiment, the power supply will be of sufficient voltage to adequately supply power to the internal electrical components of the motor 210 and the pump 215. The pump 215 may be actuated by the trigger 120, which may be connected to the motor 210. Once activated, liquid may then enter the pump 215 after it flows through the housing conduit 255. The stream of liquid may continue as long as the trigger 120 is depressed and the motor 210 is driving the pump 215. Release of the trigger 120 ceases operation of the motor 210, which, in turn, ceases operation of the pump 215. Therefore, as trigger 120 is released, the flow of liquid through the various conduits of applicator 100 ceases.

When liquid product, for example, RTU liquid product, is dispensed—i.e., when the pump 215 is activated by the trigger 120—RTU liquid is drawn from a container, such as container 400 described below with regard to FIG. 4 into the liquid input 140 of the applicator 100. The RTU liquid then passes through the pump 215, housing conduit 255, hinge conduit 220, wand conduit 225, and the nozzle 130 before being discharged via liquid outlet 135. When the trigger 120 is released, the pump ceases operation and the RTU liquid is no longer drawn from the container, ending the discharge of liquid via liquid outlet 135.

FIG. 2*b* depicts a cross-sectional view of an exemplary nozzle 130. The nozzle 130 may have a first outer portion 230 and a second outer portion 235. The second outer portion 235 may be rotatable relative to first outer portion 230 and the rotation of the second outer portion 235 may provide a variety of spray patterns in which the liquid may be discharged via liquid outlet 135. The nozzle 130 may also have a first nozzle conduit 240 and a plurality of second nozzle conduits 245. The first nozzle conduit 240 may be in fluid communication with the wand conduit 225, second nozzle conduits 245 and the liquid outlet 135. Moreover, the first outer portion 230 may have an anchor portion 250, for mating with the wand 125.

The plurality of second nozzle conduits 245 may be formed in various configurations within second outer portion 235. In an exemplary embodiment, one or more of the plurality of second nozzle conduits 245 are configured to be in fluid communication with the first nozzle conduit 240. In other exemplary embodiments, the second outer portion 235 may be rotatable relative to first outer portion 230, such that the one or more of the plurality of second nozzle conduits 245 are configured to be in selective fluid communication with the first nozzle conduit 240, depending upon the rotation of the second outer portion 235 relative to the first outer portion 230.

FIG. 2*c* depicts a cross sectional view of an applicator 100 having a housing conduit 255, a hinge conduit 220, a wand conduit 225 and a liquid conduit 260. FIG. 2*c* also depicts a liquid conduit cap 265 for coupling with a container, such as container 400, which is described in more detail below with regard to FIG. 4*a*. It should be understood that FIGS. 2*a* and 2*c* depict exemplary embodiments of an applicator 100 and that the various conduits of applicator 100 may be configured in any number of ways to facilitate fluid communication between the various components of applicator 100, as described in more detail above with regard to FIG. 2*a*.

Figure 3A:
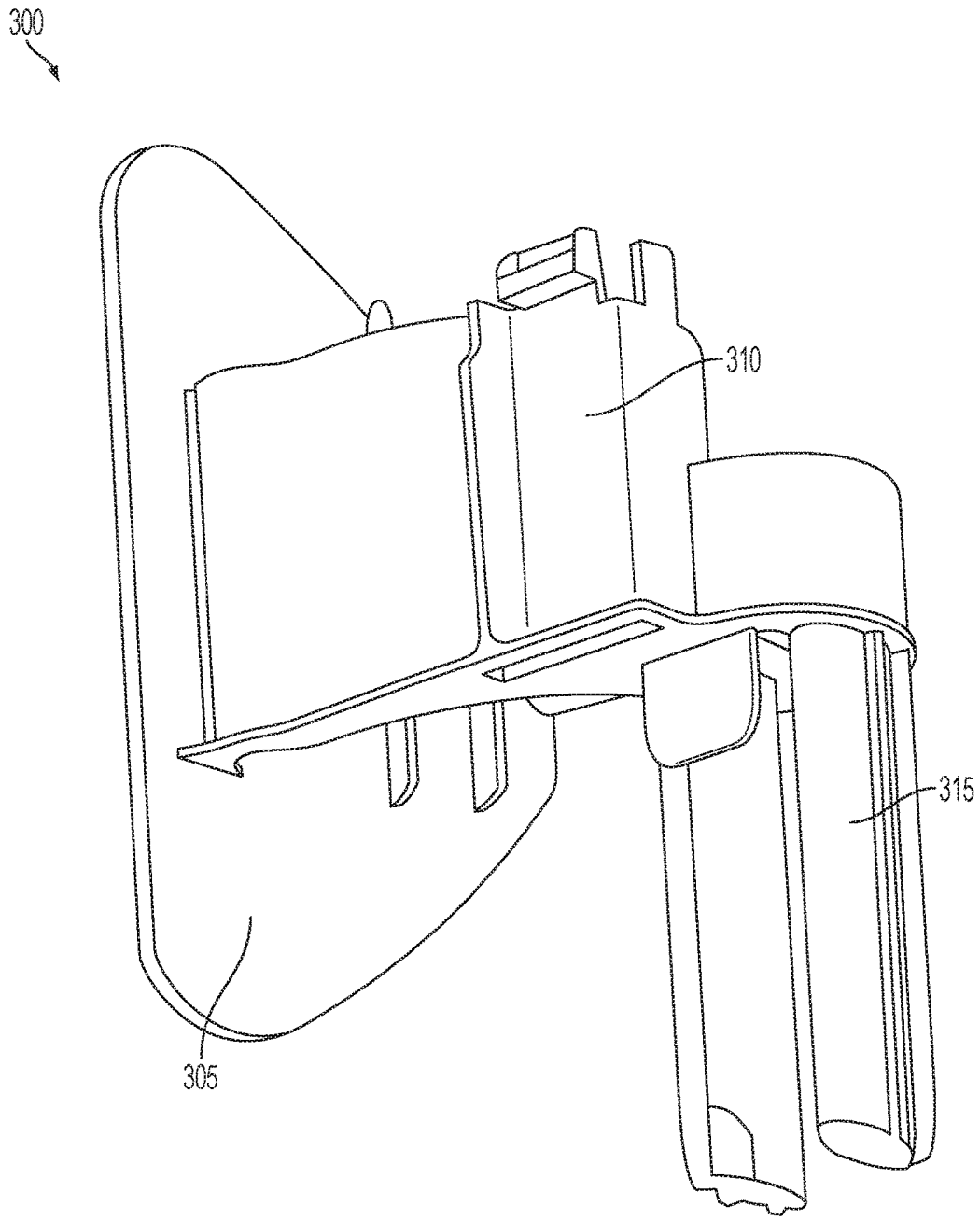
FIG. 3*a* depicts a perspective view of an applicator and applicator clip assembly.

FIG. 3*a* depicts a perspective view of an applicator clip 300. The applicator clip 300 may have a clip portion 305, a container attachment 310, and a conduit guide 315. The clip portion 305 may be configured to receive an applicator, such as applicator 100. Those with skill in the art will understand that the clip portion 305 may be configured according to any number of corresponding configurations of an applicator. In an exemplary embodiment, clip portion 305 is configured such that applicator 100 can be easily fastened and removed from applicator clip 300 by a user. The container attachment 310 may be configured to couple with an appropriately configured clip attachment, such as clip attachment 420 described below with reference to FIG. 4*a*. Moreover, the conduit guide 315 may be configured to house a conduit that fluidly connects an applicator, such as applicator 100, to a container, such as container 400, which is described in more detail below with reference to FIG. 4*a*.

Figure 3B:
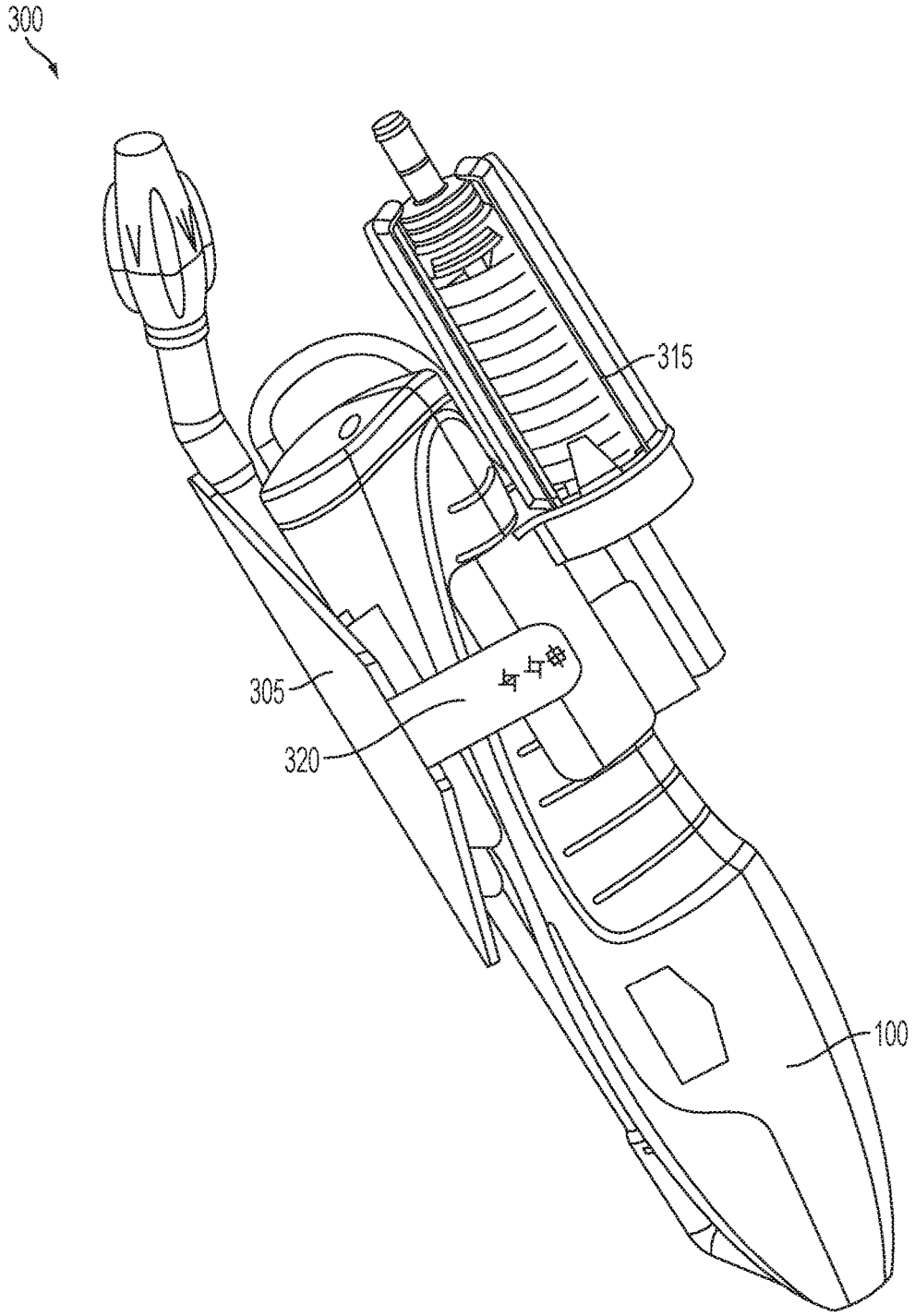
FIG. 3*b* depicts a perspective view of an applicator clip.

FIG. 3*b* depicts an exemplary embodiment of an applicator 100 coupled to an applicator clip 300. In addition to clip portion 305 and conduit guide 315, applicator clip 300 may also include a clasp 320. As depicted in FIG. 3*b*, the clasp 320 may be configured to secure the applicator 100 to the applicator clip 300. Further, a user may remove the clasp 320 in order to remove the applicator 100 from the applicator clip 300. In another exemplary embodiment, the clasp 320 may comprise a safety mechanism (not shown) in order to prevent a child from removing the applicator 100 from the applicator clip 300.

Figure 4A:
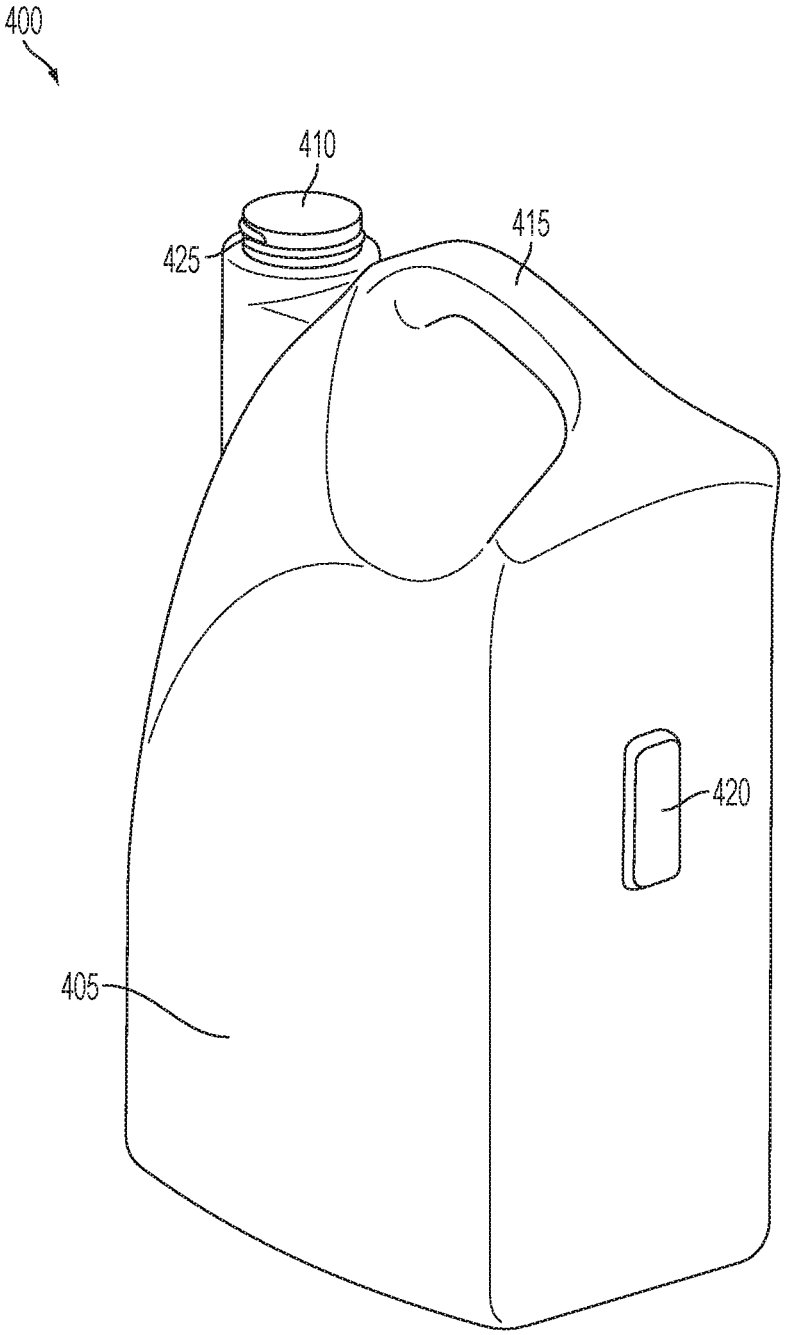
FIG. 4*a* depicts a container, in accordance with an exemplary embodiment.

FIG. 4*a* depicts an exemplary embodiment of the container 400 for the applicator 100 (not shown). As seen in FIG. 4*a*, the container 400 may comprise a base 405, a cylindrical neck 425, a handle 415, a container opening 410, and a clip attachment 420. A standard bottle cap (not shown) may be configured to attach to the cylindrical neck 425. The standard bottle cap (not shown) may have receiving grooves on its inside surface so that it can be threaded and secured onto the cylindrical neck 425 of the container 400 to seal the contents of the container 400. Overall, the container 400 may define a hollow compartment to store liquid products, for example, RTU liquid products, such as fertilizers, herbicides, insecticides, fungicides, and combinations thereof. A typical container 400 may contain, for example, a gallon of liquid product, but may also hold any other amount. The handle 415 may have a plurality of ergonomic recesses or raised grips spaced around the handle 415. The container 400 may further be translucent in order to monitor the RTU liquid levels.

Referring now to both FIGS. 2*c* and 4*a*, the liquid conduit 260 may be configured to have a liquid conduit cap 265, which may be configured to fasten over the cylindrical neck 425 in order to provide fluid communication between the liquid in liquid container 400 and liquid conduit 260. The liquid conduit cap 265 may be configured to seal the contents of container 400, except for the liquid that may flow from the container 400 to the applicator 100 when the liquid conduit 260 and the liquid conduit cap 265 when the container 400 is attached thereto. The container 400 may also include a clip attachment 420 for providing an anchor point for the clip assembly 300.

Figure 4B:
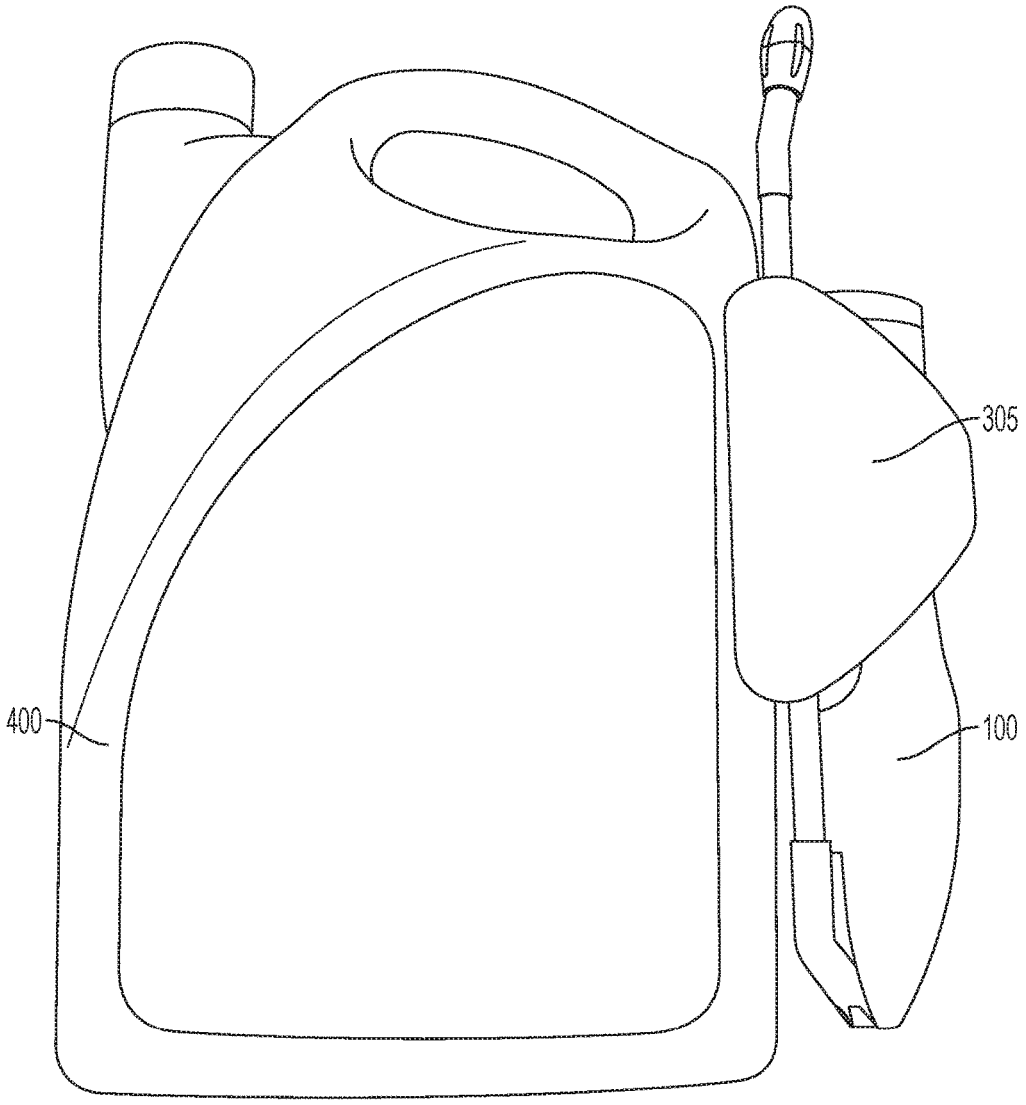
FIG. 4*b* depicts a container, an applicator clip, and an applicator assembly.

FIG. 4*b* illustrates an exemplary embodiment of a clip assembly 300 coupled to a container 400. In the exemplary embodiment depicted in FIG. 4*b*. The applicator 100 is secured within the clip assembly 300. This exemplary configuration is beneficial because it conserves space and provides efficiencies related to packaging, manufacturing, shipping and storage.

In the preceding specification, various exemplary embodiment have been described with reference to the accompanying drawings. It will, however, be evidence that various modifications and changes may be made thereto, and additional exemplary embodiments may be implemented, without departing from the broader scope of the embodiments as set forth in the claims that follow. The specification and drawings are accordingly to be regarded in an illustrative rather than restrictive sense.

The invention claimed is:

1. An applicator configured to dispense liquid comprising:

a housing, comprising:

a pump, an electric motor for driving the pump, a power source for providing power to the electric motor, and a flexible housing conduit in fluid communication with the pump;

a trigger in electronic communication with the power source and the electric motor, wherein the trigger provides manual selective control over the pump such that when the trigger is depressed, the pump is actuated and when the trigger is released, the pump ceases operation;

a wand connected to the housing via a wand hinge that is configured to allow the wand to be collapsed against the housing in a first position and extended away from the housing in a second position, the wand hinge comprises a hinge conduit engaging the flexible housing conduit and that curves around a pivot point of the wand hinge such that when the wand is collapsed against the housing in the first position, the hinge conduit keeps the flexible housing conduit apart from the pivot point of the wand hinge;

a nozzle coupled to the wand for discharging liquid from the applicator, wherein the nozzle is in fluid communication with the pump; and a liquid conduit having a proximal end in fluid communication with the pump and a distal end that extends externally from the housing, the distal end is configured to connect to a container that is external to and separate from the housing such that when the distal end of the liquid conduit is connected to the container, the container is coupled to the housing by the liquid conduit such that the container remains external to and separate from the housing.

2. The applicator of claim 1, wherein the nozzle comprises:

a first nozzle portion having a first nozzle conduit; and a second nozzle portion having several second nozzle conduits;

wherein the second nozzle portion is rotatable relative to the first nozzle portion and wherein one or more of the several second nozzle conduits align with the first nozzle conduit depending upon a position of the second nozzle portion relative to the first nozzle portion.

3. The applicator of claim 2, wherein a configuration of the several second nozzle conduits creates a variety of liquid spray patterns depending upon the position of the second nozzle portion.

4. The applicator of claim 2, wherein the second nozzle portion and the several second nozzle conduits are configured such that none of the several second nozzle conduits align with the first nozzle conduit when the second nozzle portion is rotated to a particular position relative to the first nozzle portion.

5. The applicator of claim 2, further comprising a single liquid outlet in fluid communication with the several second nozzle conduits for discharging liquid from the nozzle.

6. The applicator of claim 1, wherein the wand is rotatable via the wand hinge through an arc up to about 180 degrees between the first position and the second position.

7. The applicator of claim 1, wherein the housing further comprises a curved grip portion.

8. The applicator of claim 1, wherein the housing and the trigger are configured such that a user may grip the housing and actuate the trigger with only one hand.

9. The applicator of claim 1, wherein the power source comprises at least one battery.

10. The applicator of claim 1, further comprising a clip coupled to the container, wherein the housing and the clip are configured to be removably attached to one another.

11. The applicator of claim 1, wherein a plane, defined by an arc through which the wand swings between the first position and the second position, intersects the housing.

12. The applicator of claim 1, wherein the pivot point of the wand hinge is located internal to the housing.

13. The applicator of claim 1, further comprising a liquid conduit cap configured to be connected to the liquid conduit, the liquid conduit cap for providing a sealing interface between the container and the liquid conduit to facilitate fluid communication between the container and the pump.

14. The applicator of claim 1, wherein the wand comprises a wand conduit in fluid communication with the pump.

15. The applicator of claim 14, wherein the flexible housing conduit provides fluid communication between the pump and the wand conduit.

16. The applicator of claim 14, wherein the nozzle is in fluid communication with the pump via the wand conduit, the hinge conduit, and the flexible housing conduit.

17. The applicator of claim 16, wherein the flexible housing conduit, the wand conduit, and the hinge conduit form a continuous conduit to provide the fluid communication from the pump to the nozzle.

18. The applicator of claim 16, wherein one of the wand conduit and the hinge conduit comprises a flexible tube.

19. The applicator of claim 1, wherein the housing further comprises a liquid input; and wherein the pump is in fluid communication with the liquid conduit via the liquid input.

20. A system for dispensing liquid comprising:

a container containing a ready-to-use liquid product and comprising a cylindrical neck and a container opening; and a housing, comprising:

a pump, an electric motor for driving the pump, a power source for providing power to the electric motor, and a flexible housing conduit in fluid communication with the pump;

a trigger in electronic communication with the power source and the electric motor, wherein the trigger provides manual selective control over the pump such that when the trigger is depressed, the pump is actuated and when the trigger is released, the pump ceases operation;

a wand connected to the housing via a wand hinge that is configured to allow the wand to be collapsed against the housing in a first position and extended away from the housing in a second position, the wand hinge comprises a hinge conduit engaging the flexible housing conduit and that curves around a pivot point of the wand hinge such that when the wand is collapsed against the housing in the first position, the hinge conduit keeps the flexible housing conduit apart from the pivot point of the wand hinge;

a nozzle coupled to the wand for discharging liquid from the system, wherein the nozzle is in fluid communication with the pump; and a liquid conduit having a proximal end in fluid communication with the pump and a distal end that extends externally from the housing and connects to the container via a liquid conduit cap such that when the distal end of the liquid conduit is connected to the container, the container is coupled to the housing by the liquid conduit such that the container remains external to and separate from the housing;

wherein the liquid conduit cap providing a sealing interface between the container opening and the liquid conduit to facilitate fluid communication between the container opening and the pump.

21. The system of claim 20, wherein the ready-to-use liquid product comprises one of a fertilizer or pesticide.

22. The system of claim 20, wherein the nozzle comprises:

a first nozzle portion having a first nozzle conduit; and a second nozzle portion having several second nozzle conduits;

wherein the second nozzle portion is rotatable relative to the first nozzle portion and wherein one or more of the several second nozzle conduits align with the first nozzle conduit depending upon a position of the second nozzle portion relative to the first nozzle portion.

23. The system of claim 22, wherein the second nozzle portion and the several second nozzle conduits are configured such that none of the several second nozzle conduits align with the first nozzle conduit when the second nozzle portion is rotated to a particular position relative to the first nozzle portion.

24. The system of claim 22, further comprising a single liquid outlet in fluid communication with the several second nozzle conduits for discharging liquid from the nozzle.

25. The system of claim 20, wherein the pivot point of the wand hinge is located internal to the housing.

26. The system of claim 20, wherein the wand is rotatable via the wand hinge through an arc up to about 180 degrees between the first position and the second position.

27. The system of claim 20, wherein the housing further comprises a curved grip portion.

28. The system of claim 20, further comprising a clip coupled to the container, wherein the housing and the clip are configured to be removably attached to one another.

29. The system of claim 20, wherein the wand comprises a wand conduit in fluid communication with the pump; and wherein the flexible housing conduit provides fluid communication between the pump and the wand conduit.

30. The system of claim 20, wherein the wand comprises a wand conduit in fluid communication with the pump; and wherein the nozzle is in fluid communication with the pump via the wand conduit, the hinge conduit, and the flexible housing conduit.

31. The system of claim 30, wherein the flexible housing conduit, the wand conduit, and the hinge conduit form a continuous conduit to provide the fluid communication from the pump to the nozzle.

32. The system of claim 30, wherein one of the wand conduit and the hinge conduit comprises a flexible tube.

33. The system of claim 20, wherein the housing further comprises a liquid input; and wherein the pump is in fluid communication with the liquid conduit via the liquid input.

34. A system for dispensing liquid comprising:

a container containing a ready-to-use liquid product and comprising a cylindrical neck and a container opening; and a housing, comprising:

a pump, an electric motor for driving the pump, a power source for providing power to the electric motor, and a flexible housing conduit in fluid communication with the pump;

a trigger in electronic communication with the power source and the electric motor, wherein the trigger provides manual selective control over the pump such that when the trigger is depressed, the pump is actuated and when the trigger is released, the pump ceases operation;

a wand connected to the housing via a wand hinge, the wand comprising a wand conduit;

the wand hinge is configured to allow the wand to be collapsed against the housing in a first position and extended away from the housing in a second position, the wand hinge comprises a hinge conduit that engages and is in fluid communication with the flexible housing conduit and the wand conduit, the hinge conduit curves around a pivot point of the wand hinge such that when the wand is collapsed against the housing in the first position, the hinge conduit keeps the flexible housing conduit apart from the pivot point of the wand hinge;

a nozzle coupled to the wand for discharging liquid from the system, wherein the nozzle is in fluid communication with the wand conduit; and a liquid conduit having a proximal end in fluid communication with the pump and a distal end that extends externally from the housing and connects to the container via a liquid conduit cap such that when the distal end of the liquid conduit is connected to the container, the container is coupled to the housing by the liquid conduit such that the container remains external to and separate from the housing;

wherein the liquid conduit cap providing a sealing interface between the container opening and the liquid conduit to facilitate fluid communication between the container opening and the pump.

35. The system of claim 34, wherein the wand is rotatable via the wand hinge through an arc up to about 180 degrees between the first position and the second position.

36. The system of claim 34, wherein the pivot point of the wand hinge is located internal to the housing.

37. The system of claim 34, wherein the nozzle is in fluid communication with the pump via the wand conduit, the hinge conduit, and the flexible housing conduit.

38. The system of claim 37, wherein the flexible housing conduit, the wand conduit, and the hinge conduit form a continuous conduit to provide the fluid communication from the pump to the nozzle.

39. An applicator configured to dispense a liquid comprising:

a housing comprising:

a pump, an electric motor for driving the pump, a power source for providing power to the electric motor, and a flexible housing conduit in fluid communication with the pump;

a trigger in electronic communication with the power source and the electric motor, wherein the trigger provides manual selective control over the pump such that when the trigger is depressed, the pump is actuated and when the trigger is released, the pump ceases operation;

a wand connected to the housing via a wand hinge that is configured to allow the wand to be collapsed against the housing in a first position and extended away from the housing in a second position, the wand hinge comprises a hinge conduit engaging the flexible housing conduit and that curves around a pivot point of the wand hinge such that when the wand is collapsed against the housing in the first position, the hinge conduit keeps the flexible housing conduit apart from the pivot point of the wand hinge;

a nozzle coupled to the wand for discharging liquid from the applicator, wherein the nozzle is in fluid communication with the pump; and a liquid conduit having a proximal end and a distal end, at least a portion of the proximal end of the liquid conduit is within the housing and is in fluid communication with the pump, the distal end of the liquid conduit extends externally from the housing and is configured to connect to a container that is external to and separate from the housing.

40. The applicator of claim 39, wherein the nozzle comprises:

a first nozzle portion having a first nozzle conduit; and a second nozzle portion having several second nozzle conduits;

wherein the second nozzle portion is rotatable relative to the first nozzle portion and wherein one or more of the several second nozzle conduits align with the first nozzle conduit depending upon a position of the second nozzle portion relative to the first nozzle portion.

41. The applicator of claim 40, wherein the second nozzle portion and the several second nozzle conduits are configured such that none of the several second nozzle conduits align with the first nozzle conduit when the second nozzle portion is rotated to a particular position relative to the first nozzle portion.

42. The applicator of claim 40, further comprising a single liquid outlet in fluid communication with the several second nozzle conduits for discharging liquid from the nozzle.

43. The applicator of claim 39, wherein the wand is rotatable via the wand hinge through an arc up to about 180 degrees between the first position and the second position.

44. The applicator of claim 39, wherein the housing further comprises a curved grip portion.

45. The applicator of claim 39, wherein the pivot point of the wand hinge is located internal to the housing.

46. The applicator of claim 39, wherein the wand comprises a wand conduit in fluid communication with the pump.

47. The applicator of claim 46, wherein the flexible housing conduit provides fluid communication between the pump and the wand conduit.

48. The applicator of claim 46, wherein the nozzle is in fluid communication with the pump via the wand conduit, the hinge conduit, and the flexible housing conduit.

49. The applicator of claim 48, wherein the flexible housing conduit, the wand conduit, and the hinge conduit form a continuous conduit to provide the fluid communication from the pump to the nozzle.

50. The applicator of claim 48, wherein one of the wand conduit and the hinge conduit comprises a flexible tube.

51. The applicator of claim 39, wherein the housing further comprises a liquid input; and wherein the pump is in fluid communication with the liquid conduit via the liquid input.

* * * * *